US010662510B2

(12) United States Patent
Park et al.

(10) Patent No.: US 10,662,510 B2
(45) Date of Patent: May 26, 2020

(54) DUCTILE IRON COMPOSITION AND PROCESS OF FORMING A DUCTILE IRON COMPONENT

(71) Applicant: GENERAL ELECTRIC COMPANY, Schenectady, NY (US)

(72) Inventors: Junyoung Park, Greer, SC (US); Brian Victor Moore, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 968 days.

(21) Appl. No.: 15/142,732

(22) Filed: Apr. 29, 2016

(65) Prior Publication Data

US 2017/0314105 A1 Nov. 2, 2017

(51) Int. Cl.

| | |
|---|---|
| ***C22C 37/10*** | (2006.01) |
| ***B22D 1/00*** | (2006.01) |
| ***B22D 41/00*** | (2006.01) |
| ***C21C 1/10*** | (2006.01) |
| ***C22C 33/06*** | (2006.01) |
| ***C22C 33/10*** | (2006.01) |

(Continued)

(52) U.S. Cl.

CPC ..... *C22C 37/10* (2013.01); *B22D 1/00* (2013.01); *B22D 41/00* (2013.01); *C21C 1/105* (2013.01); *C22C 33/06* (2013.01); *C22C 33/10* (2013.01); *C22C 37/04* (2013.01); *F27B 17/0016* (2013.01)

(58) Field of Classification Search

CPC ..... C22C 37/10; C22C 33/06; C22C 37/04; C22C 33/10; C21C 1/105; B22D 41/00; B22D 1/00; F27B 17/0016

See application file for complete search history.

(56) References Cited

U.S. PATENT DOCUMENTS

| | | | |
|---|---|---|---|
| 3,549,430 | A | 12/1970 | Kies et al. |
| 3,702,269 | A | 11/1972 | Church |

(Continued)

FOREIGN PATENT DOCUMENTS

| | | | |
|---|---|---|---|
| CN | 105063467 | A | 11/2015 |
| EP | 2465952 | A1 | 6/2012 |

(Continued)

OTHER PUBLICATIONS

Glavas, et al., "The Properties of Silicon Alloyed Ferritic Ductile Irons," Metalurgija 55 (2016) 3, pp. 293-296 (Year: 2016).*

(Continued)

*Primary Examiner* — John A Hevey

(74) *Attorney, Agent, or Firm* — McNees Wallace & Nurick LLC

(57) ABSTRACT

A ductile iron composition including, by weight:
about 3.1% to about 3.6% C;
about 3.5% to about 4.0% Si;
about 0.035% to about 0.050% Mg;
about 0.001% to about 0.004% Ce;
up to about 0.005% Sb;
about 0.008% to about 0.016% S;
up to about 0.04% P;
up to about 0.3% Mn; and
balance iron and incidental impurities;

The ductile iron composition includes a ratio of Sb/Ce greater than or equal to about 1.25, has a ferritic microstructure and graphite nodules, and greater than about 65% of the graphite nodules having a highly spherical geometry. A method and apparatus for forming a ductile iron composition are also disclosed.

20 Claims, 2 Drawing Sheets

(51) Int. Cl.
*C22C 37/04* (2006.01)
*F27B 17/00* (2006.01)

(56) References Cited

U.S. PATENT DOCUMENTS

| | | | | |
|---|---|---|---|---|
| 3,965,962 | A | 6/1976 | Tanaka et al. | |
| 4,391,636 | A | 7/1983 | Windish | |
| 4,484,953 | A | 11/1984 | Kovacs et al. | |
| 4,702,886 | A | 11/1987 | Kent | |
| 4,880,477 | A | 11/1989 | Hayes et al. | |
| 5,028,281 | A | 7/1991 | Hayes et al. | |
| 5,139,579 | A | 8/1992 | Kovacs et al. | |
| 2011/0017364 | A1 | 1/2011 | Park et al. | |
| 2014/0093416 | A1* | 4/2014 | Dekker | F01D 25/24 420/17 |
| 2015/0284830 | A1 | 10/2015 | Fay et al. | |
| 2016/0053351 | A1* | 2/2016 | Fujimoto | C22C 33/08 420/28 |

FOREIGN PATENT DOCUMENTS

| | | | | |
|---|---|---|---|---|
| GB | 898809 | A | 6/1962 | |
| GB | 2189257 | A * | 10/1987 | C22C 38/02 |
| JP | S58-45310 | A | 3/1983 | |

OTHER PUBLICATIONS

Extended European Search Report and Opinion issued in connection with corresponding EP Application No. 17168428.5 dated Aug. 28, 2017.

Glavas, Z., et al., "The properties of silicon alloyed ferritic ductile irons," Metalurgija, vol. 55, Issue 3, pp. 293-296 (2016).

Office Action issued in connection with corresponding EP Application No. 17168428.5 dated Aug. 2, 2018.

* cited by examiner

DUCTILE IRON COMPOSITION AND PROCESS OF FORMING A DUCTILE IRON COMPONENT

FIELD OF THE INVENTION

The present invention is directed to ductile iron composition, articles including the ductile iron compositions, and processes of forming ductile iron. More specifically, the present invention is directed to a solid solution strengthened ductile iron having increased toughness, wear resistance, ductility, and strength including tensile and fatigue.

BACKGROUND OF THE INVENTION

Wind turbines are exposed to significant operational stresses from wind, rotational forces and the weight of a plurality of blades. The operational stresses are often amplified by environmental temperatures with extremes depending on geographical location. The materials used for the components of the wind turbines must be able to withstand operating stresses and strains throughout the range of temperatures.

Due to their strength, toughness, castability and machinability, ductile iron (cast nodular iron) alloys have also been used to produce wind turbine components. The strength of cast iron has been improved remarkably by the development of spheroidal graphite cast iron, i.e. ductile cast iron, but its ductility and impact resistance are still behind those of steel, making steel the desirable material for a variety of components, including gearbox components. To improve the mechanical properties of ductile iron, attempts at refining of the graphite nodules of the alloying of special elements have been made, but not succeeded yet in obtaining sufficient results. In addition, these processes may have such disadvantages as complicated or energy intensive processing.

BRIEF DESCRIPTION OF THE INVENTION

In an exemplary embodiment of the present disclosure, a ductile iron composition including, by weight:

about 3.1% to about 3.6% C;
about 3.5% to about 4.0% Si;
about 0.035% to about 0.050% Mg;
about 0.001% to about 0.004% Ce;
up to about 0.005% Sb;
about 0.008% to about 0.016% S;
up to about 0.04% P;
up to about 0.3% Mn; and
balance iron and incidental impurities;

The ductile iron composition includes a ratio of Sb/Ce greater than or equal to about 1.25, has a ferritic microstructure and graphite nodules, and greater than about 65% of the graphite nodules having a highly spherical geometry.

In another embodiment of the present disclosure, a method of forming a ductile iron component. The method includes forming a melt of a charge alloy, nodularizing the melt with a nodularizing composition, inoculating the melt with an inoculation composition to nucleate graphite nodules and form a ductile iron component having a ductile iron composition including, by weight:

about 3.1% to about 3.6% C;
about 3.5% to about 4.0% Si;
about 0.035% to about 0.050% Mg;
about 0.001% to about 0.004% Ce;
up to about 0.005% Sb;
about 0.008% to about 0.016% S;

up to about 0.04% P;
up to about 0.3% Mn; and
balance iron and incidental impurities;

The ductile iron composition includes a ratio of Sb/Ce greater than or equal to about 1.25, has a ferritic microstructure and graphite nodules, and greater than about 65% of the graphite nodules having a highly spherical geometry.

In another embodiment of the present disclosure, an apparatus for forming a ductile iron composition having a primary chamber arranged and disposed to receive a charge material, a treatment chamber in fluid communication with the primary chamber. The treatment chamber includes a layer system having a nodularizing composition layer, a cover layer, and a delay material layer. The nodularizing composition layer, cover layer and delay material layer are arranged to contact the charge material and nodularize the charge alloy with sufficient delay to permit filling at least a portion of the chamber with the charge alloy prior to contact of the charge material with the nodularizing composition layer. The apparatus further includes an antechamber in fluid communication with the primary chamber arranged and disposed to receive and deliver the charge material to the primary chamber in a manner such that contact between the charge material and the delay material layer does not fluidly disturb the delay material layer.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
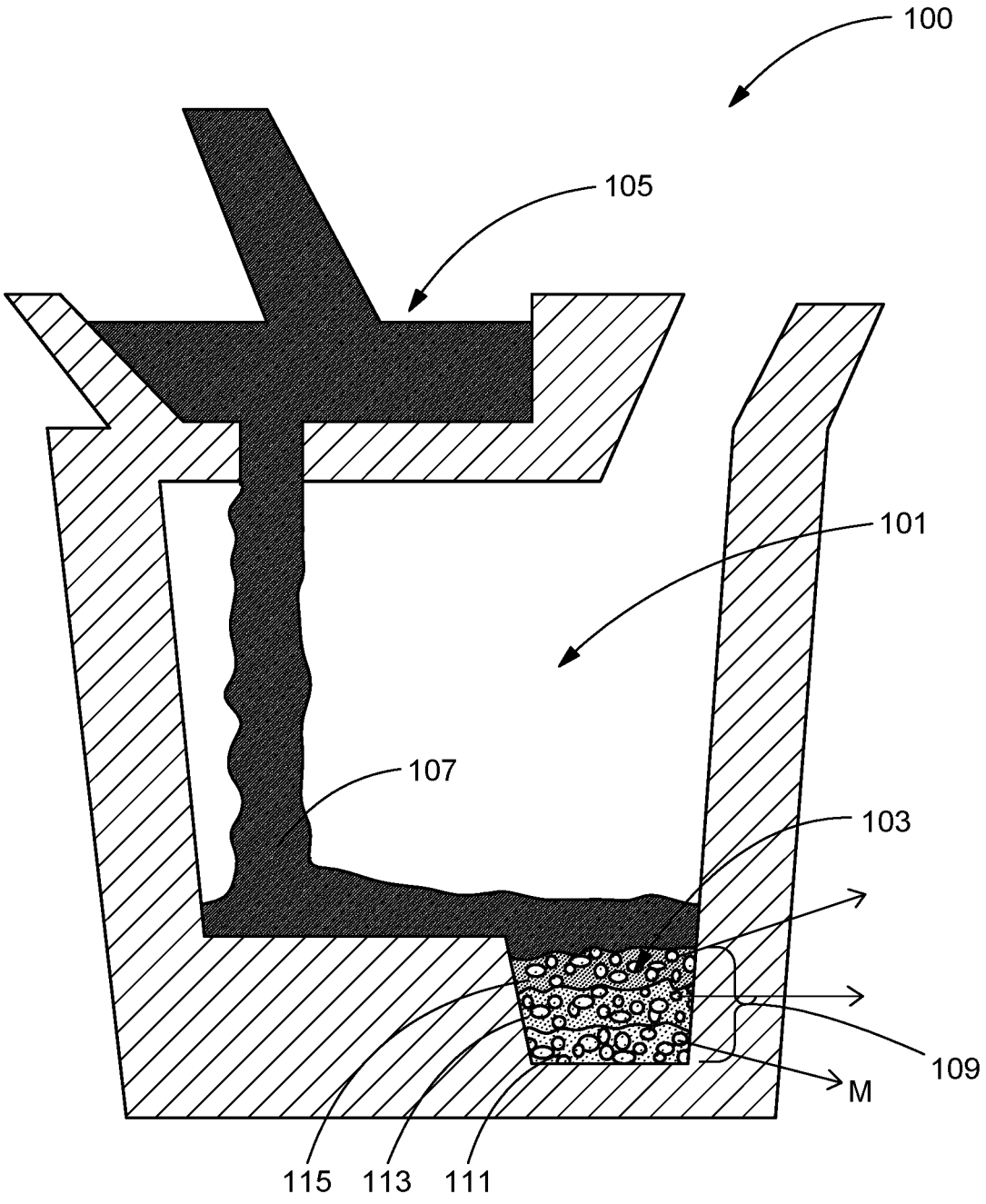
FIG. 1 is a schematic view of an apparatus, according to the present disclosure.

Provided is an exemplary ductile iron composition and a process of forming the ductile iron component having a plurality of predetermined properties. Embodiments of the present disclosure, in comparison to methods and products not utilizing one or more features disclosed herein, increased strength, including fatigue strength and tensile strength, increased ductility, increased machinability, increased wear resistance or any combination thereof.

The terms "first," "second", and the like, herein do not denote any order, quantity, or importance, but rather are used to distinguish one element from another, and the terms "a" and "an" herein do not denote a limitation of quantity, but rather denote the presence of at least one of the referenced item. The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25%, or, more specifically, about 5% to about 20%", is inclusive of the endpoints and all intermediate values of the ranges of "about 5% to about 25%," etc.).

The modifier "about" used in connection with a quantity is inclusive of the stated value and has the meaning dictated by the context, (e.g., includes the degree of error associated with measurement of the particular quantity). For example, a quantitative value indicated as being about a number may vary by about +/−10%.

In one embodiment, the disclosure includes a process for producing a component for a wind turbine from a ductile iron composition, though it should be understood that the invention is also well suited for the production of a wide variety of components from ductile iron compositions. Other non-limiting examples include gas turbine, automotive or oil and gas components, such as shafts, gears, axles, and various other components used in the energy, automotive, railroad, construction, mining and agricultural industries. Other components may include hubs, gearbox components, valve bodies, pump bodies and casings. Such components are well known in the art and therefore require no further description.

Ductile iron composition, according to embodiments of the present disclosure, contain, by weight, about 3.1% to about 3.6% carbon, about 3.5% to about 4.0% silicon, about 0.035% to about 0.050% magnesium, about 0.001% to about 0.004% cerium, up to about 0.005% antimony, about 0.008% to about 0.016% sulfur, up to about 0.04% phosphorus, up to about 0.3% manganese, and balance iron and incidental impurities. As known in the art, the level for carbon is necessary for graphite formation and castability considerations. The role of silicon is generally to promote the formation of graphite instead of metastable iron carbide during solidification. The carbon content separates as spheroidal graphite during solidification, primarily as the result of the presence of silicon. The range of sulfur present in the composition according to the present disclosure promotes inoculation, hence better nodularity, less pearlite, and enhanced mechanical properties. The spheroidal graphite imparts such desirable properties as high strength, including tensile and fatigue strength, and toughness for which ductile iron alloys are known.

In a further embodiment, the ductile iron composition includes about 3.1% to about 3.4% carbon, about 3.5% to about 3.9% silicon, about 0.037% to about 0.047% magnesium, about 0.002% to about 0.003% cerium, about 0.002% to about 0.004% antimony, about 0.010% to about 0.014% sulfur, up to about 0.04% phosphorus, up to about 0.3% manganese, and balance iron and incidental impurities.

In a further embodiment, the ductile iron composition includes about 3.2% to about 3.3% carbon, about 3.7% to about 3.9% silicon, about 0.040% to about 0.045% magnesium, about 0.002% to about 0.003% cerium, about 0.003% to about 0.004% antimony, about 0.010% to about 0.014% sulfur, up to about 0.04% phosphorus, up to about 0.3% manganese, and balance iron and incidental impurities.

The ductile iron composition, according to the present disclosure, includes graphite nodules having varied spherical geometries. The microstructure of the ductile iron composition includes a substantially ferritic structure containing less than 5 areal % pearlite and less than 0.5 areal % carbides. In one embodiment, at least 65%, or at least 70% or at least 75% or at least 80% or at least 85% of the graphite nodules are highly spherical. By highly spherical, as utilized herein, the graphite nodules have a geometry of at least Type VI according to ISO 945-1:2008 standard. In addition, in one embodiment, no more than 30% of the graphite nodules are substantially spherical. By substantially spherical, as utilized herein, the graphite nodules have a geometry of Type V according to ISO 945-1:2008 standard. In one embodiment, the nodule density for highly spherical and substantially spherical graphite nodules is greater than 75 per $mm^2$ or greater than 85 per $mm^2$ or 100 per $mm^2$.

The ductile iron composition, according to the present disclosure, includes mechanical properties resulting from the specific microstructure and graphite nodule geometry and density formed. For example, the ductile iron composition includes a tensile strength of greater than about 540 MPa or greater than about 545 MPa or greater than about 550 MPa. The ductile iron composition, according to the present disclosure, includes a 0.2% yield strength of greater than about 435 MPa or greater than about 440 MPa or greater than about 445 MPa or greater than about 450 MPa. The ductile iron composition, according to the present disclosure, includes an elongation of greater than 15.0% or greater than about 15.5% or greater than about 16% or greater than about 17%. In certain embodiments of the disclosure, the mechanical properties vary based upon thickness of the component. For example, components having wall thicknesses of less than 30 mm include a tensile strength of greater than about 580 MPa, a 0.2% yield strength of greater than about 450 MPa, an elongation of greater than 13.2% and a Brinell hardness between about 190 to 220. Components having wall thicknesses from about 30 mm to 60 mm include a tensile strength of greater than about 560 MPa, a 0.2% yield strength of greater than about 430 MPa, an elongation of greater than 13.0% and a Brinell hardness between about 190 to 220. Components having wall thicknesses from about 90 mm to 200 mm include a tensile strength of greater than about 530 MPa, a 0.2% yield strength of greater than about 430 MPa, an elongation of greater than 12.5% and a Brinell hardness between about 185 to 220.

The ductile iron composition, according to the present disclosure, is formed treating a charge material with a specific composition to nodularize and inoculate the charge composition. The method includes forming a melt of a charge material. The charge material is any suitable material for forming the melt. Suitable mixtures for the charge material include a composition having 20-40% in-house return, 30-50% pig iron, 10-20% steel scrap. The composition is selected to result in the desired alloy composition after nodularization and inoculation. After the melt is formed, the charge composition is nodularized with a nodularizing composition. Nodularizing includes contacting the charge material with a nodularizing composition. The nodularizing composition is a material that nodularizes graphite within the ductile iron composition to form graphite nodules.

In one embodiment, the nodularizing composition comprises, by weight, from about 1.0% to about 1.4% of the charge alloy and nodularizing composition. In one embodiment, the nodularizing composition includes two portions, including a first portion and a second portion. In this embodiment, the first portion comprises, by weight, of the first portion about 0.2 to about 2.0% Al, about 0.2 to about 2.0% Ca, about 0.2 to about 2.0% rare earth elements, about 4.0 to about 8.0% Mg and balance essentially ferrosilicon. The second portion of the nodularizing composition includes, by weight, about 0.2 to about 2.0% Al, about 0.2 to about 2.0% Ca, less than about 0.1% rare earth elements, about 4.0 to about 8.0% Mg and balance essentially ferrosilicon.

To form the ductile iron composition, according to the present disclosure, the composition is inoculated. Inoculation is accomplished by contacting an inoculating composition with the charge material. Inoculation may occur at various stages of the process. For example, inoculating may be done in the furnace, in the ladle, at other stages in the formation process or in combination of these points in the process. Inoculating the charge material with the inoculating composition nucleates the graphite nodules and assists in the formation of a higher nodule density with desired nodule geometry. One composition suitable for use as an inoculating composition includes a ferrosilicon composition comprising, by weight, of the composition about 0.2 to about 2.0% Al, about 0.2 to about 2.0% Ca, and about 1.0 to about 2.0% Ce.

FIG. 1 shows an apparatus 100 for forming a ductile iron composition, including nodularization, according to the present invention. The apparatus 100 includes a primary chamber 101, a treatment chamber 103 and an antechamber 105. The primary chamber 101 is arranged and disposed to receive a charge material 107. The apparatus 100 further includes the treatment chamber 103, which is in fluid communication with the primary chamber 101, the treatment chamber 103 includes a space configured to house layer system 109. The layer system 109 includes a nodularizing composition layer 111, a cover layer 113 and a delay material layer 115. The nodularizing composition layer 111, cover layer 113 and delay material layer 115 are arranged to contact the charge material 107 and nodularize the charge material 107 with sufficient delay to permit filling at least a portion of the primary chamber 101 with the charge material 107 prior to contact of the charge material 107 with the nodularizing composition layer 111. In one embodiment, the layer system 109 is arranged such that 90% or 80% or 70% by volume of the primary chamber 101 is filled prior to initiation of nodularization by the nodularizing composition layer 111.

The antechamber 105 is in fluid communication with the primary chamber 101 and is arranged and disposed to receive and deliver the charge material 107 to the primary chamber 101 in a manner such that contact between the charge material 107 and the delay material layer 115 does not fluidly disturb the delay material layer 115. For example, the antechamber 105 is arranged that the discharge of the charge material 107 is to a portion of the primary chamber 101 that does not directly flow onto the delay material layer 115.

In one embodiment, the layer system further includes a cover layer 113 between the nodularizing composition layer 111 and the delay material layer 115. In one embodiment, the cover layer 113 includes a ferrosilicon composition comprising, by weight, about 40 to about 60% or about 45 to about 55% or about 50% Si, about 0.5 to about 3.0% Ca or about 1.0 to about 2.5% Ca or about 1.5 to about 2.0% Ca; and about 1.5 to about 3.5% or about 2.0 to about 3.0% or about 2.5 Ba and balance essentially iron. The cover layer 113 provides additional delay to nodularization and also provides some inoculation of the charge composition.

In one embodiment, the delay material layer 115 is a divided iron containing material. Suitable material for the delay material layer includes, but is not limited to, steel punchings or pig iron.

In one embodiment, as shown in FIG. 1, the nodularizing composition layer 111, cover layer 113 and delay material layer 115 are layered in the treatment chamber 103 with the delay material layer 115 adjacent the primary chamber 101.

The ductile iron composition, according to the present disclosure, after nodularization and inoculation, is cast using casting techniques known in the art for casting.

The ductile iron composition may be heat treated according to known heat treating processes known for heat treating known ductile irons. However, in one embodiment, the ductile iron composition is not heat treated and is utilized in a substantially cast form.

Examples

The following examples are intended to further illustrate the present invention. They are not intended to limit the invention in any way. Unless otherwise indicated, all parts are by weight.

Table 1 shows ductile iron compositions formed, according to the process of the present disclosure.

TABLE 1

| Example Number | C | Si | Mn | P | S | Mg | Sb | Ce | Sb/Ce |
|---|---|---|---|---|---|---|---|---|---|
| 1 | 3.13 | 3.83 | 0.18 | 0.031 | 0.01 | 0.038 | 0.0054 | 0.0034 | 1.59 |
| 2 | 3.15 | 3.83 | 0.211 | 0.027 | 0.01 | 0.0414 | 0.0049 | 0.0034 | 1.44 |
| 3 | 3.13 | 3.85 | 0.209 | 0.031 | 0.01 | 0.037 | 0.005 | 0.0034 | 1.47 |
| 4 | 3.16 | 3.8 | 0.19 | 0.029 | 0.01 | 0.0381 | 0.0053 | 0.0034 | 1.56 |
| 5 | 3.2 | 3.86 | 0.212 | 0.025 | 0.01 | 0.0403 | 0.005 | 0.0033 | 1.52 |
| 6 | 3.17 | 3.8 | 0.2 | 0.028 | 0.01 | 0.0384 | 0.0055 | 0.0039 | 1.41 |
| 7 | 3.07 | 3.8 | 0.196 | 0.03 | 0.01 | 0.04 | 0.0049 | 0.0038 | 1.29 |
| 8 | 3.13 | 3.83 | 0.215 | 0.024 | 0.01 | 0.0446 | 0.0046 | 0.002 | 2.3 |
| 9 | 3.12 | 3.86 | 0.178 | 0.031 | 0.01 | 0.0402 | 0.0049 | 0.003 | 1.63 |
| 10 | 3.08 | 3.8 | 0.177 | 0.032 | 0.01 | 0.0411 | 0.0054 | 0.0032 | 1.69 |
| 11 | 3.16 | 3.83 | 0.226 | 0.0274 | 0.0082 | 0.0417 | 0.0051 | 0.004 | 1.28 |

(all concentrations in weight percent of composition)

Table 2 shows properties of the ductile iron compositions formed, according to the process of the present disclosure shown in Table 1.

TABLE 2

| Example Number | Tensile Strength Mpa Min | 0.2% Yield Mpa Min | Elong. % Min | Impact at -20° C. |
|---|---|---|---|---|
| 1 | 575 | 470 | 17.9 | 13.9/12.3/16.9 |
| 2 | 565 | 460 | 16 | 7.9/8.8/8.2 |
| 3 | 558 | 457 | 15.1 | 10.4/10.8/10.6 |
| 4 | 564 | 455 | 20.3 | 8.4/12.1/12.9 |
| 5 | 558 | 456 | 15.9 | 8.9/9.3/11.1 |
| 6 | 557 | 457 | 17.7 | 8.2/9.4/10.2 |
| 7 | 545 | 445 | 19.3 | 19.6/20.2/20.0 |
| 8 | 544 | 454 | 19.3 | 14.9/10.5/13.3 |
| 9 | 546 | 444 | 17.1 | 10.4/11.2/11.5 |
| 10 | 541 | 441 | 19.1 | 12.8/16.4/16.8 |
| 11 | 541 | 439 | 16.1 | 10.6/11.5/10.8 |

Figure 2:
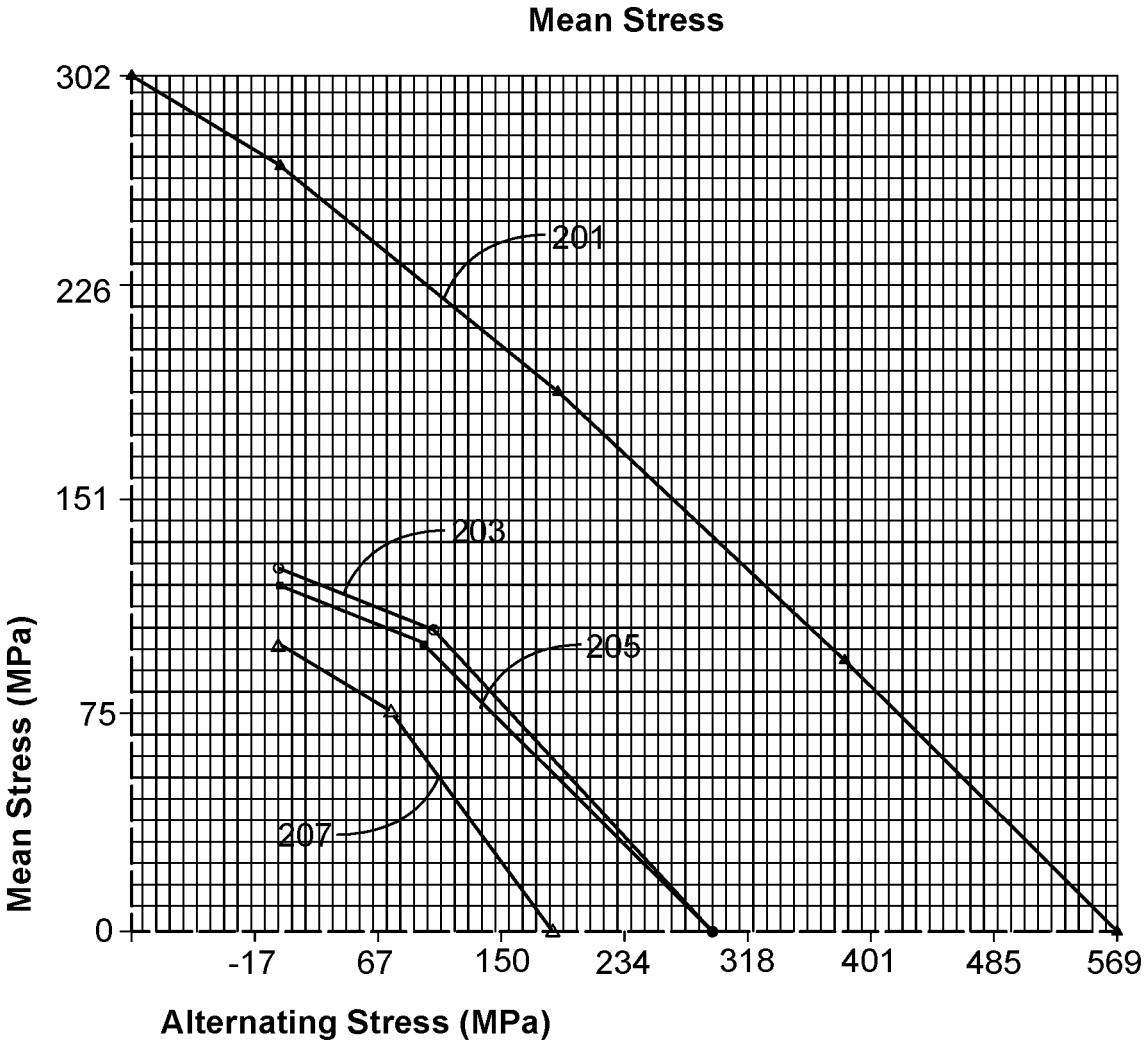
FIG. 2 shows a graph showing mean stress and alternating stress according to comparative composition and compositions, according to the present disclosure.

FIG. 2 shows a graph showing mean stress and alternating stress according to comparative composition and compositions, according to the present disclosure. As shown in FIG. 2, an inventor composition 201, according to the present disclosure, is compared to known alloy compositions 203, 205, 207. The chart provided shows the enhanced fatigue strength associated with this invention, which is the most critical property when it comes to structural components including wind turbine hubs and bedplates.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A ductile iron composition comprising, by weight:
about 3.1% to about 3.6% C;
about 3.5% to about 4.0% Si;
about 0.035% to about 0.050% Mg;
about 0.001% to about 0.004% Ce;
up to about 0.005% Sb;
about 0.008% to about 0.016% S;
up to about 0.04% P;
up to about 0.3% Mn; and
balance iron and incidental impurities;
wherein the ductile iron composition:
includes a ratio of Sb/Ce greater than or equal to about 1.25;
has a ferritic microstructure and graphite nodules, and greater than about 65% of the graphite nodules have a highly spherical geometry; and
includes an elongation of greater than 12.5%.

2. The composition of claim 1, wherein the ductile iron composition includes less than about 30% of the graphite nodules having a substantially spherical geometry.

3. The composition of claim 1, wherein the composition includes a tensile strength of greater than about 540 MPa.

4. The composition of claim 1, wherein the composition includes a 0.2% yield strength of greater than about 435 MPa.

5. The composition of claim 1, wherein the composition includes an elongation of greater than 15.0%.

6. The composition of claim 1, wherein the composition has a nodule density of greater than 75 per $mm^2$ of highly spherical and substantially spherical graphite nodules.

7. A method for forming a ductile iron composition comprising:
forming a melt of a charge material;
nodularizing the charge alloy with a nodularizing composition;
inoculating the charge material with an inoculating composition to nucleate graphite nodules and form a ductile iron composition comprising, by weight:
about 3.1% to about 3.6% C;
about 3.5% to about 4.0% Si;
about 0.035% to about 0.050% Mg;
about 0.001% to about 0.004% Ce;
up to about 0.005% Sb;
about 0.008% to about 0.016% S;
up to about 0.04% P;
up to about 0.3% Mn; and
balance iron and incidental impurities;
wherein the ductile iron composition includes a ratio of Sb/Ce greater than or equal to about 1.25, has a ferritic microstructure and graphite nodules, has greater than about 65% of the graphite nodules having a highly spherical geometry, and includes an elongation of greater than 12.5%.

8. The method of claim 7, wherein the nodularizing composition comprises, by weight:
a first portion comprising, by weight, of the first portion:
about 0.2 to about 2.0% Al;
about 0.2 to about 2.0% Ca;
about 0.2 to about 2.0% rare earth elements;
about 4.0 to about 8.0% Mg; and
balance essentially ferrosilicon and incidental impurities; and
second portion comprising, by weight, of the first portion:
about 0.2 to about 2.0% Al;
about 0.2 to about 2.0% Ca;
less than about 0.1% rare earth elements;
about 4.0 to about 8.0% Mg;
and balance essentially ferrosilicon and incidental impurities.

9. The composition of claim 1, wherein the composition includes, by weight:
3.1% to 3.6% C;
3.5% to 4.0% Si;
0.035% to 0.050% Mg;
0.001% to 0.004% Ce;
up to 0.005% Sb;
0.008% to 0.016% S;
up to 0.04% P;
up to 0.3% Mn; and
balance iron and incidental impurities.

10. The composition of claim 1, wherein the composition includes, by weight:
about 3.1% to about 3.4% C;
about 3.5% to about 3.9% Si;
about 0.037% to about 0.047% Mg;
about 0.002% to about 0.003% Ce;
about 0.002% to about 0.004% Sb;
about 0.010% to about 0.014% S;
up to about 0.04% P;
up to about 0.3% Mn; and
balance iron and incidental impurities.

11. The composition of claim 10, wherein the composition includes, by weight:
3.1% to 3.4% C;
3.5% to 3.9% Si;
0.037% to 0.047% Mg;
0.002% to 0.003% Ce;
0.002% to 0.004% Sb;
0.010% to 0.014% S;
up to 0.04% P;
up to 0.3% Mn; and
balance iron and incidental impurities.

12. The composition of claim 10, wherein the composition includes, by weight:
about 3.2% to about 3.3% C;
about 3.7% to about 3.9% Si;
about 0.040% to about 0.045% Mg;
about 0.002% to about 0.003% Ce;
about 0.003% to about 0.004% Sb;
about 0.010% to about 0.014% S;
up to about 0.04% P;
up to about 0.3% Mn; and
balance iron and incidental impurities.

13. The composition of claim 12, wherein the composition includes, by weight:
3.2% to 3.3% C;
3.7% to 3.9% Si;

0.040% to 0.045% Mg;
0.002% to 0.003% Ce;
0.003% to 0.004% Sb;
0.010% to 0.014% S;
up to 0.04% P;
up to 0.3% Mn; and
balance iron and incidental impurities.

14. The composition of claim 1, wherein the composition includes less than 5 areal % pearlite and less than 0.5 areal % carbides.

15. The composition of claim 1, wherein the composition includes at least 85% of the graphite nodules having the highly spherical geometry.

16. The composition of claim 3, wherein the tensile strength is greater than about 550 MPa.

17. The composition of claim 4, wherein the 0.2% yield strength is greater than about 450 MPa.

18. The composition of claim 5, wherein the elongation is greater than 17.0%.

19. The composition of claim 6, wherein the nodule density of highly spherical and substantially spherical graphite nodules is greater than 100 per $mm^2$.

20. A ductile iron composition consisting of, by weight:
about 3.1% to about 3.6% C;
about 3.5% to about 4.0% Si;
about 0.035% to about 0.050% Mg;
about 0.001% to about 0.004% Ce;
up to about 0.005% Sb;
about 0.008% to about 0.016% S;
up to about 0.04% P;
up to about 0.3% Mn; and
balance iron and incidental impurities;
wherein the ductile iron composition:
includes a ratio of Sb/Ce greater than or equal to about 1.25; and
has a ferritic microstructure and graphite nodules, and greater than about 65% of the graphite nodules have a highly spherical geometry.

* * * * *